US010625396B2

(12) United States Patent
Xue et al.

(10) Patent No.: US 10,625,396 B2
(45) Date of Patent: Apr. 21, 2020

(54) WHEEL END FACE DETECTION AND CORRECTION DEVICE

(71) Applicant: CITIC Dicastal CO., LTD, Qinhuangdao (CN)

(72) Inventors: Bowen Xue, Qinhuangdao (CN); Jiangtao Zhou, Qinhuangdao (CN); Xiuwei Wang, Qinhuangdao (CN); Jiandong Guo, Qinhuangdao (CN)

(73) Assignee: CITIC DICASTAL CO., LTD, Qinhuangdao, Hebei (CN)

( * ) Notice: Subject to any disclaimer, the term of this patent is extended or adjusted under 35 U.S.C. 154(b) by 274 days.

(21) Appl. No.: 15/941,136

(22) Filed: Mar. 30, 2018

(65) Prior Publication Data

US 2019/0193244 A1 Jun. 27, 2019

(30) Foreign Application Priority Data

Dec. 21, 2017 (CN) ..... 2017 1 1395439

(51) Int. Cl.

| | |
|---|---|
| ***G01B 5/255*** | (2006.01) |
| ***B24B 51/00*** | (2006.01) |
| ***B24B 5/44*** | (2006.01) |

(52) U.S. Cl.
CPC ..... *B24B 51/00* (2013.01); *B24B 5/44* (2013.01)

(58) Field of Classification Search
CPC ..... G01B 5/255
USPC ..... 33/203, 203.18
See application file for complete search history.

(56) References Cited

U.S. PATENT DOCUMENTS

| | | | | |
|---|---|---|---|---|
| 6,282,799 | B1 * | 9/2001 | Warkotsch | G01B 5/255 33/203.18 |
| 2016/0346887 | A1 * | 12/2016 | Xue | B23Q 7/043 |
| 2019/0195738 | A1 * | 6/2019 | Xue | G01B 5/255 |
| 2019/0351474 | A1 * | 11/2019 | Xue | B23B 5/28 |
| 2020/0009618 | A1 * | 1/2020 | Xue | B08B 3/022 |

* cited by examiner

*Primary Examiner* — George B Bennett
(74) *Attorney, Agent, or Firm* — Calfee, Halter & Griswold LLP

(57) ABSTRACT

Disclosed is an improved wheel end face detection and correction device, which includes a detection and correction system, a synchronous clamping system, an expansion and rotating system, compression and positioning systems, a lifting system and the like. The device may be used for detecting the end face run-out of the flange of a wheel and implementing on-line correction, and has the characteristics of high automation degree, advanced process, strong universality and safe and stable performance at the same time.

2 Claims, 3 Drawing Sheets

WHEEL END FACE DETECTION AND CORRECTION DEVICE

CROSS-REFERENCE TO RELATED APPLICATIONS

This application claims priority to Chinese Patent Application No. 201711395439.9 filed on Dec. 21, 2017, which is hereby incorporated by reference in its entirety.

TECHNICAL FIELD

The present application relates to an end face detection and correction device, and specifically, to an improved wheel end face detection and correction device.

BACKGROUND ART

In the machining process of an aluminum alloy wheel, the end face run-out of the machined wheel is often unqualified due to end face deformation and clamping deformation of a blank, so that the wheel vibrates in the running process to affect the driving safety and comfort.

SUMMARY OF THE INVENTION

The aim of the present application is to provide an improved wheel end face detection and correction device, which may be used for detecting the end face run-out of the flange of a wheel and implementing on-line correction.

In order to fulfill the above aim, the technical solution of the present application is: improved wheel end face detection and correction device, includes a frame, a servo motor I, a lower fixed plate I, a gear I, a rack I, guide rails I, a servo electric cylinder I, a left sliding plate I, a guide sleeve I, a correction column, gears II, racks II, a lower fixed plate II, a guide rail II, a left sliding plate II, clamping blocks, an expansion core, an expansion sleeve, a datum plate, a cylinder rod, a piston, a cylinder body, pressure blocks, compression columns, guide sleeves II, upper sliding plates, guide rails III, servo electric cylinders II, servo electric cylinders III, upper fixed plates I, servo motors II, connecting blocks, upper fixed plates II, annular guide rails, gears III, a lifting plate, guide posts, a belt pulley I, a synchronous belt, a belt pulley II, a servo motor III, guide sleeves III, a cylinder I, cylinders II, a rotary joint, a spline shaft, a spline sleeve, a bearing seat, a right sliding plate I, a cylinder III, a guide sleeve IV, a vertical plate, a guide rail IV, a lifting support, a dial indicator, a servo electric cylinder IV and a right sliding plate II.

A detection and correction system includes: the servo motor I is fixed below the lower fixed plate I, and the gear I is fixed at the output end of the servo motor I; the left sliding plate I is mounted on the left side above the lower fixed plate I via a guide rail I; the right sliding plate II is mounted on the right side above the lower fixed plate I via a guide rail I; two ends of the rack I are respectively connected with the left sliding plate I and the right sliding plate II, and engaged with the gear I; the guide sleeve I is fixed above the left sliding plate I, and the correction column is matched with the guide sleeve I; the servo electric cylinder I is fixed below the left sliding plate I, and the output end of the servo electric cylinder I is connected with the lower part of the correction column; the vertical plate is fixed above the right sliding plate II; the lifting support is mounted on the right side of the vertical plate via the guide rail IV; the servo electric cylinder IV is fixed below the right sliding plate II, and the output end of the servo electric cylinder IV is connected with the lifting support; the guide sleeve IV is fixed above the lifting support, and the dial indicator is fixed below the lifting support.

A synchronous clamping system includes: the gears II are fixed above the lower fixed plate II; the left sliding plate II is fixed above the lower fixed plate II via the guide rail II; two clamping blocks are fixed above the left sliding plate II; a rack II is fixed below the left sliding plate II, and engaged with the lower part of one gear II; two clamping blocks are also fixed above the right sliding plate I, and a rack II is also fixed below the right sliding plate I and engaged with the upper part of the other gear II; the cylinder III is fixed on the right side of the frame, and the output end of the cylinder III is connected with the right sliding plate I.

An expansion and rotating system includes: the expansion sleeve is fixed below the datum plate; the expansion core is matched with the expansion sleeve; the lower part of the cylinder rod is connected with the expansion core, and the upper part of the cylinder rod is connected with the piston; the piston is connected with an inner hole of the cylinder body; the bearing seat is fixed below the lifting plate; the spline sleeve is mounted inside the bearing seat via a bearing; the spline shaft is matched with the spline sleeve; the top of the cylinder body is fixed below the spline shaft; the top of the spline shaft is connected with the lower part of the rotary joint; the belt pulley II is fixed above the spline sleeve; the servo motor III is fixed above the lifting plate, and the belt pulley I is fixed at the output end of the servo motor III; the belt pulley I is connected with the belt pulley II via the synchronous belt; the cylinder I is fixed at the top of the frame, and the output end of the cylinder I is connected with the upper part of the rotary joint.

A compression and positioning system includes: the guide sleeve II is fixed below the upper sliding plate; the compression column is matched with the guide sleeve II, and the pressure block is fixed below the compression column; the upper sliding plate is mounted below the upper fixed plate I via the guide rail III; the servo electric cylinder II is fixed on the left side below the upper fixed plate I, and the output end of the servo electric cylinder II is connected with the upper sliding plate; the servo electric cylinder III is fixed above the upper sliding plate, and the output end of the servo electric cylinder is connected with the upper part of the compression column; the upper fixed plate I is fixed below the upper fixed plate II via the connecting block; the upper fixed plate II is mounted below the lifting plate via the annular guide rail; the servo motor II is fixed below the upper fixed plate II, and the gear III is fixed at the output end of the servo motor II; the gear III is engaged with the edge of the lifting plate; and this device includes three compression and positioning systems.

A lifting system includes: the four guide posts are fixed above the lifting plate; the four guide sleeves III are matched with the guide posts, and fixed at the top of the frame; the two cylinders II are also fixed at the top of the frame, and the output ends of the two cylinders II are articulated with the top of the lifting plate.

The outer ring of the lifting plate is a large gear, which is engaged with the three gears III.

In the working process, the cylinder III drives the four clamping blocks via the gears II and the racks II to synchronously center a wheel; the cylinder I drives the spline shaft and the expansion sleeve to descend, the datum plate is attached to a flange face of the wheel, the piston drives the cylinder rod to pull the expansion core, and the expansion sleeve expands a center hole of the wheel; the cylinders II drive the wheel via the guide posts to ascend, and the servo motor III drives the spline sleeve and the wheel via the synchronous belt to rotate; the servo motor I drives the dial indicator via the gear I and the rack I to be located below the end face of the lower flange of the wheel, the servo electric cylinder IV drives the dial indicator via the guide rail IV to ascend, the contact of the dial indicator contacts the lower flange of the wheel, and the end face run-out of the lower flange may be detected after the wheel rotates one cycle; the overproof run-out position rotates to the middle of the left two clamping blocks, and then the four clamping blocks clamp the wheel; the three pressure blocks may be adjusted to proper positions under the drive of the servo motors II and the servo electric cylinders II via the annular guide rails and the guide rails III, the right pressure block is positioned in the middle of the right two clamping blocks, the left two pressure blocks are respectively positioned above the left two clamping blocks, and the three servo electric cylinders III compress the wheel; meanwhile, the servo motor I drives the correction column via the gear I and the rack I to move to a position below the end face of the lower flange of the wheel and in the middle of the left two clamping blocks, and the servo electric cylinder I drives the correction column to jack the wheel to correct the wheel.

The present application may be used for detecting the end face run-out of the flange of a wheel and implementing on-line correction, and has the characteristics of high automation degree, advanced process, strong universality and safe and stable performance at the same time.

Figure 1:
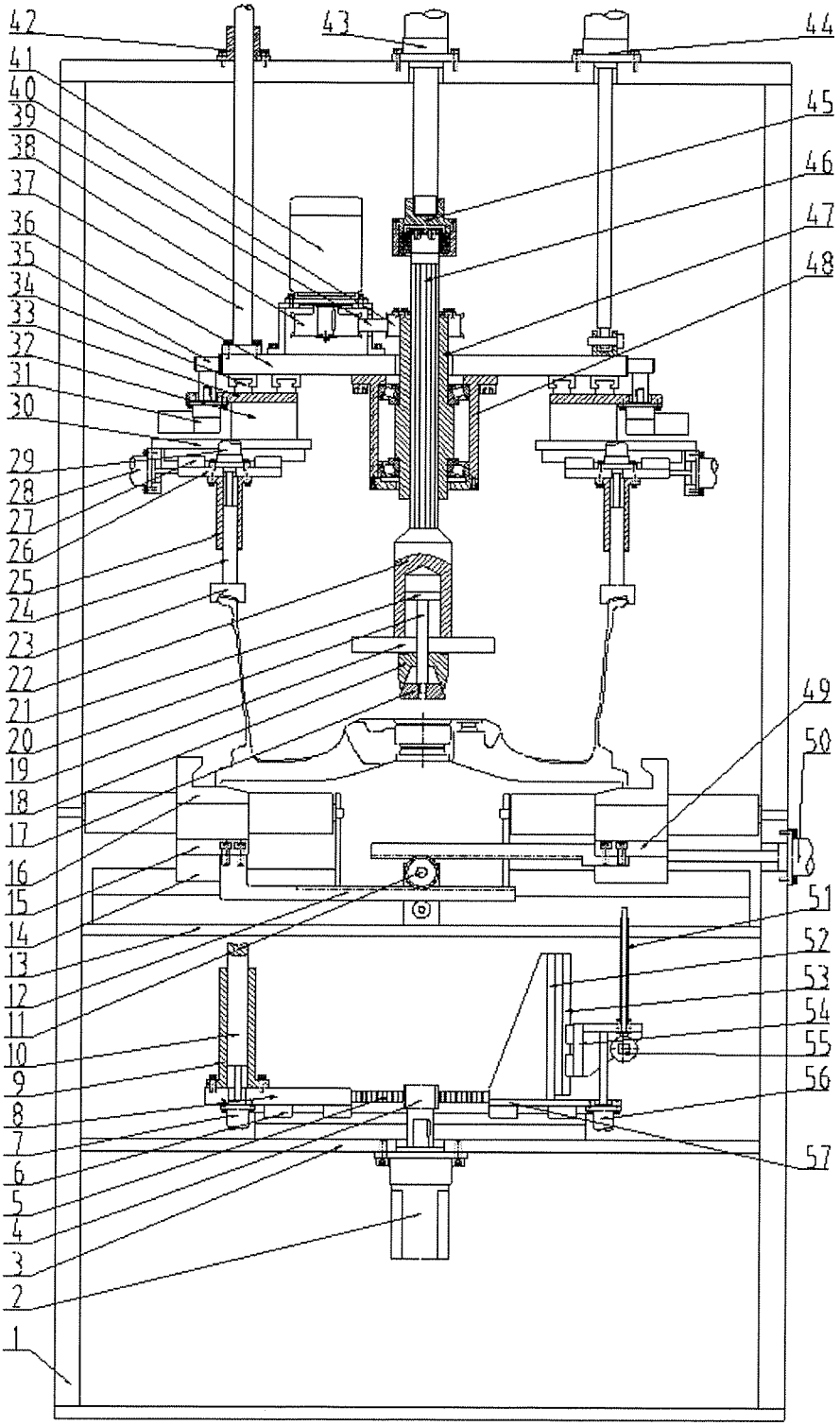
FIG. 1 is a front view of an improved wheel end face detection and correction device of the present application.
Figure 2:
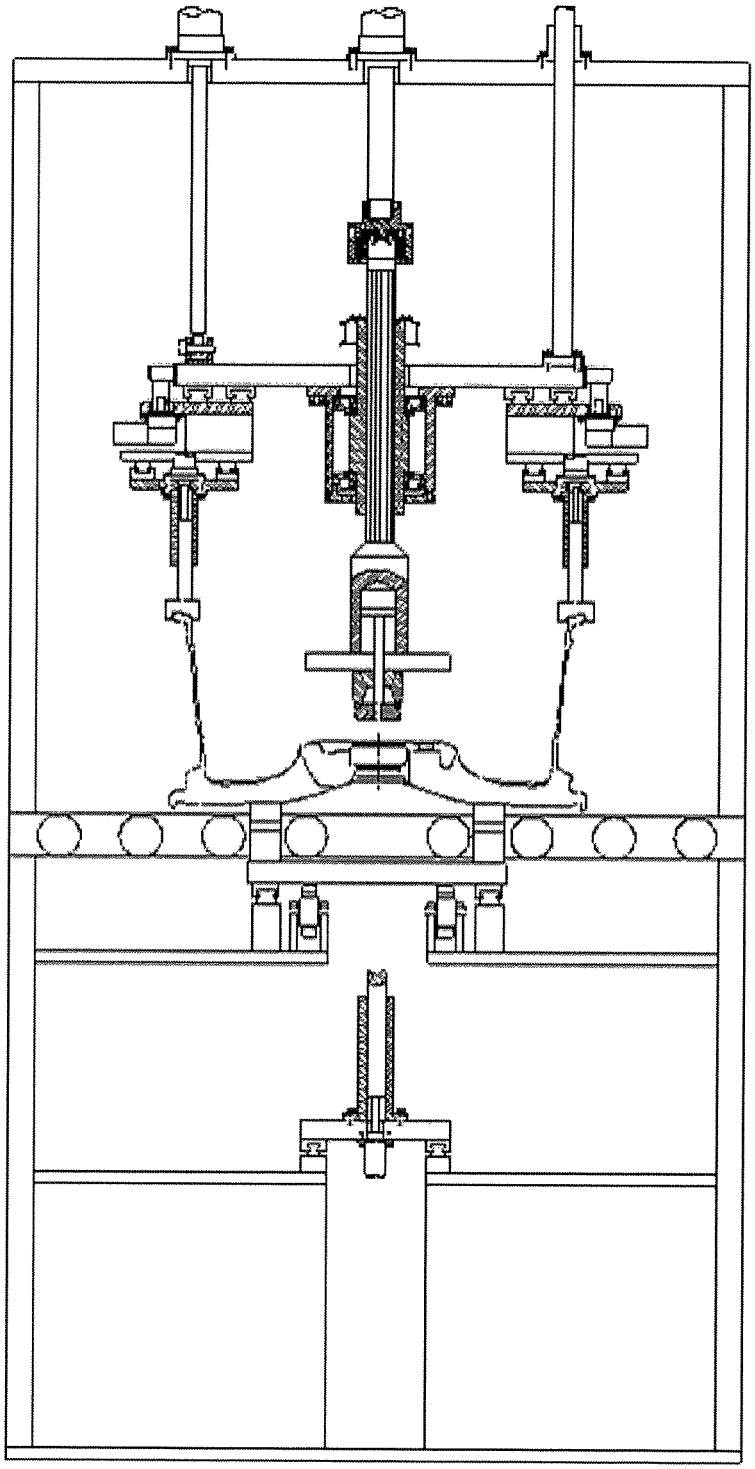
FIG. 2 is a left view of the improved wheel end face detection and correction device of the present application.
Figure 3:
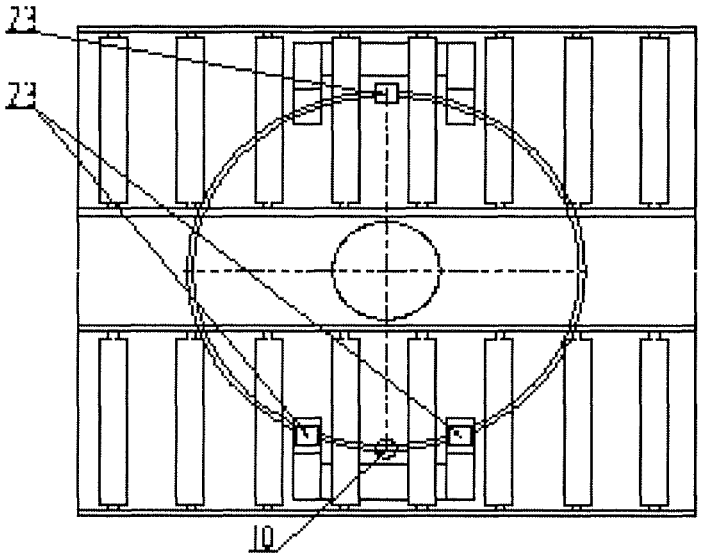
FIG. 3 is a partial top view of the improved wheel end face detection and correction device of the present application in work.

In which: 1-frame, 2-servo motor I, 3-lower fixed plate I, 4-gear I, 5-rack I, 6-guide rail I, 7-servo electric cylinder I, 8-left sliding plate I, 9-guide sleeve I, 10-correction column, 11-gear II, 12-rack II, 13-lower fixed plate II, 14-guide rail II, 15-left sliding plate II, 16-clamping block, 17-expansion core, 18-expansion sleeve, 19-datum plate, 20-cylinder rod, 21-piston, 22-cylinder body, 23-pressure block, 24-compression column, 25-guide sleeve II, 26-upper sliding plate, 27-guide rail III, 28-servo electric cylinder II, 29-servo electric cylinder III, 30-upper fixed plate I, 31-servo motor II, 32-connecting block, 33-upper fixed plate II, 34-annular guide rail, 35-gear III, 36-lifting plate, 37-guide post, 38-belt pulley I, 39-synchronous belt, 40-belt pulley II, 41-servo motor III, 42-guide sleeve III, 43-cylinder I, 44-cylinder II, 45-rotary joint, 46-spline shaft, 47-spline sleeve, 48-bearing seat, 49-right sliding plate I, 50-cylinder III, 51-guide sleeve IV, 52-vertical plate, 53-guide rail IV, 54-lifting support, 55-dial indicator, 56-servo electric cylinder IV, 57-right sliding plate II.

DETAILED DESCRIPTION OF THE INVENTION

Specific details and working conditions of a device provided by the present application will be described below in combination with the accompanying drawings.

The device includes a frame 1, a servo motor I 2, a lower fixed plate I 3, a gear I 4, a rack I 5, guide rails I 6, a servo electric cylinder I 7, a left sliding plate I 8, a guide sleeve I 9, a correction column 10, gears II 11, racks II 12, a lower fixed plate II 13, a guide rail II 14, a left sliding plate II 15, clamping blocks 16, an expansion core 17, an expansion sleeve 18, a datum plate 19, a cylinder rod 20, a piston 21, a cylinder body 22, pressure blocks 23, compression columns 24, guide sleeves II 25, upper sliding plates 26, guide rails III 27, servo electric cylinders II 28, servo electric cylinders III 29, upper fixed plates I 30, servo motors II 31, connecting blocks 32, upper fixed plates II 33, annular guide rails 34, gears III 35, a lifting plate 36, guide posts 37, a belt pulley I 38, a synchronous belt 39, a belt pulley II 40, a servo motor III 41, guide sleeves III 42, a cylinder I 43, cylinders II 44, a rotary joint 45, a spline shaft 46, a spline sleeve 47, a bearing seat 48, a right sliding plate I 49, a cylinder III 50, a guide sleeve IV 51, a vertical plate 52, a guide rail IV 53, a lifting support 54, a dial indicator 55, a servo electric cylinder IV 56, a right sliding plate II 57 and the like.

A detection and correction system includes: the servo motor I 2 is fixed below the lower fixed plate I 3, and the gear I 4 is fixed at the output end of the servo motor I 2; the left sliding plate I 8 is mounted on the left side above the lower fixed plate I 3 via a guide rail I 6; the right sliding plate II 57 is mounted on the right side above the lower fixed plate I 3 via a guide rail I 6; two ends of the rack I 5 are respectively connected with the left sliding plate I 8 and the right sliding plate II 57, and engaged with the gear I 4; the guide sleeve I 9 is fixed above the left sliding plate I 8, and the correction column 10 is matched with the guide sleeve I 9; the servo electric cylinder I 7 is fixed below the left sliding plate I 8, and the output end of the servo electric cylinder I 7 is connected with the lower part of the correction column 10; the vertical plate 52 is fixed above the right sliding plate II 57; the lifting support 54 is mounted on the right side of the vertical plate 52 via the guide rail IV 53; the servo electric cylinder IV 56 is fixed below the right sliding plate II 57, and the output end of the servo electric cylinder IV 56 is connected with the lifting support 54; the guide sleeve IV 51 is fixed above the lifting support 54, and the dial indicator 55 is fixed below the lifting support 54.

A synchronous clamping system includes: the gears II 11 are fixed above the lower fixed plate II 13; the left sliding plate II 15 is fixed above the lower fixed plate II 13 via the guide rail II 14; two clamping blocks 16 are fixed above the left sliding plate II 15; a rack II 12 is fixed below the left sliding plate II 15, and engaged with the lower part of one gear II 11; two clamping blocks 16 are also fixed above the right sliding plate I 49, and a rack II 12 is also fixed below the right sliding plate I 49 and engaged with the upper part of the other gear II 11; the cylinder III 50 is fixed on the right side of the frame 1, and the output end of the cylinder III 50 is connected with the right sliding plate I 49.

An expansion and rotating system includes: the expansion sleeve 18 is fixed below the datum plate 19; the expansion core 17 is matched with the expansion sleeve 18; the lower part of the cylinder rod 20 is connected with the expansion core 17, and the upper part of the cylinder rod 20 is connected with the piston 21; the piston 21 is connected with an inner hole of the cylinder body 22; the bearing seat 48 is fixed below the lifting plate 36; the spline sleeve 47 is mounted inside the bearing seat 48 via a bearing; the spline shaft 46 is matched with the spline sleeve 47; the top of the cylinder body 22 is fixed below the spline shaft 46; the top of the spline shaft 46 is connected with the lower part of the rotary joint 45; the belt pulley II 40 is fixed above the spline sleeve 47; the servo motor III 41 is fixed above the lifting plate 36, and the belt pulley I 38 is fixed at the output end of the servo motor III 41; the belt pulley I 38 is connected with the belt pulley II 40 via the synchronous belt 39; the cylinder I 43 is fixed at the top of the frame 1, and the output end of the cylinder I 43 is connected with the upper part of the rotary joint 45.

A compression and positioning system comprises: the guide sleeve II 25 is fixed below the upper sliding plate 26; the compression column 24 is matched with the guide sleeve II 25, and the pressure block 23 is fixed below the compression column 24; the upper sliding plate 26 is mounted below the upper fixed plate I 30 via the guide rail III 27; the servo electric cylinder II 28 is fixed on the left side below the upper fixed plate I 30, and the output end of the servo electric cylinder II 28 is connected with the upper sliding plate 26; the servo electric cylinder III 29 is fixed above the upper sliding plate 26, and the output end of the servo electric cylinder III 29 is connected with the upper part of the compression column 24; the upper fixed plate I 30 is fixed below the upper fixed plate II 33 via the connecting block 32; the upper fixed plate II 33 is mounted below the lifting plate 36 via the annular guide rail 34; the servo motor II 31 is fixed below the upper fixed plate II 33, and the gear III 35 is fixed at the output end of the servo motor II 31; the gear III 35 is engaged with the edge of the lifting plate 36; and this device includes three compression and positioning systems.

A lifting system includes: the four guide posts 37 are fixed above the lifting plate 36; the four guide sleeves III 42 are matched with the guide posts 37, and fixed at the top of the frame 1; the two cylinders II 44 are also fixed at the top of the frame 1, and the output ends of the two cylinders II 44 are articulated with the top of the lifting plate 36.

The outer ring of the lifting plate 36 is a large gear, which is engaged with the three gears III 35.

In the working process, the cylinder III 50 drives the four clamping blocks 16 via the gears II 11 and the racks II 12 to synchronously center a wheel; the cylinder I 43 drives the spline shaft 46 and the expansion sleeve 18 to descend, the datum plate 19 is attached to a flange face of the wheel, the piston 21 drives the cylinder rod 20 to pull the expansion core 17, and the expansion sleeve 18 expands a center hole of the wheel; the cylinders II 44 drive the wheel via the guide posts 37 to ascend, and the servo motor III 41 drives the spline sleeve 47 and the wheel via the synchronous belt 39 to rotate; the servo motor I 2 drives the dial indicator 55 via the gear I 4 and the rack I 5 to be located below the end face of the lower flange of the wheel, the servo electric cylinder IV 56 drives the dial indicator 55 via the guide rail IV 53 to ascend, the contact of the dial indicator 55 contacts the lower flange of the wheel, and the end face run-out of the lower flange may be detected after the wheel rotates one cycle; the overproof run-out position rotates to the middle of the left two clamping blocks 16, and then the four clamping blocks 16 clamp the wheel; the three pressure blocks 23 may be adjusted to proper positions under the drive of the servo motors II 31 and the servo electric cylinders II 28 via the annular guide rails 34 and the guide rails III 27, the right pressure block 23 is positioned in the middle of the right two clamping blocks 16, the left two pressure blocks 23 are respectively positioned above the left two clamping blocks 16, and the three servo electric cylinders III 29 compress the wheel; meanwhile, the servo motor I 2 drives the correction column 10 via the gear I 4 and the rack I 5 to move to a position below the end face of the lower flange of the wheel and in the middle of the left two clamping blocks 16, and the servo electric cylinder I 7 drives the correction column 10 to jack the wheel to correct the wheel.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An improved wheel end face detection and correction device, comprising a frame, a servo motor I, a lower fixed plate I, a gear I, a rack I, guide rails I, a servo electric cylinder I, a left sliding plate I, a guide sleeve I, a correction column, gears II, racks II, a lower fixed plate II, a guide rail II, a left sliding plate II, clamping blocks, an expansion core, an expansion sleeve, a datum plate, a cylinder rod, a piston, a cylinder body, pressure blocks, compression columns, guide sleeves II, upper sliding plates, guide rails III, servo electric cylinders II, servo electric cylinders III, upper fixed plates I, servo motors II, connecting blocks, upper fixed plates II, annular guide rails, gears III, a lifting plate, guide posts, a belt pulley I, a synchronous belt, a belt pulley II, a servo motor III, guide sleeves III, a cylinder I, cylinders II, a rotary joint, a spline shaft, a spline sleeve, a bearing seat, a right sliding plate I, a cylinder III, a guide sleeve IV, a vertical plate, a guide rail IV, a lifting support, a dial indicator, a servo electric cylinder IV and a right sliding plate II, a detection and correction system comprises: the servo motor I is fixed below the lower fixed plate I, and the gear I is fixed at an output end of the servo motor I; the left sliding plate I is mounted on the left side above the lower fixed plate I via a guide rail I; the right sliding plate II is mounted on the right side above the lower fixed plate I via a guide rail I; two ends of the rack I are respectively connected with the left sliding plate I and the right sliding plate II, and engaged with the gear I; the guide sleeve I is fixed above the left sliding plate I, and the correction column is matched with the guide sleeve I; the servo electric cylinder I is fixed below the left sliding plate I, and an output end of the servo electric cylinder I is connected with the lower part of the correction column; the vertical plate is fixed above the right sliding plate II; the lifting support is mounted on the right side of the vertical plate via the guide rail IV; the servo electric cylinder IV is fixed below the right sliding plate II, and an output end of the servo electric cylinder IV is connected with the lifting support; the guide sleeve IV is fixed above the lifting support, and the dial indicator is fixed below the lifting support;

a synchronous clamping system comprises: the gears II are fixed above the lower fixed plate II; the left sliding plate II is fixed above the lower fixed plate II via the guide rail II; two clamping blocks are fixed above the left sliding plate II; a rack II is fixed below the left sliding plate II, and engaged with the lower part of one gear II; two clamping blocks are also fixed above the right sliding plate I, and a rack II is also fixed below the right sliding plate I and engaged with the upper part of the other gear II; the cylinder III is fixed on the right side of the frame, and an output end of the cylinder III is connected with the right sliding plate I;

an expansion and rotating system comprises: the expansion sleeve is fixed below the datum plate; the expansion core is matched with the expansion sleeve; the lower part of the cylinder rod is connected with the expansion core, and the upper part of the cylinder rod is connected with the piston; the piston is connected with an inner hole of the cylinder body; the bearing seat is fixed below the lifting plate; the spline sleeve is mounted inside the bearing seat via a bearing; the spline shaft is matched with the spline sleeve; the top of the cylinder body is fixed below the spline shaft; the top of the spline shaft is connected with the lower part of the rotary joint; the belt pulley II is fixed above the spline sleeve; the servo motor III is fixed above the lifting plate, and the belt pulley I is fixed at the output end of the servo motor III; the belt pulley I is connected with the belt pulley II via the synchronous belt; the cylinder I is fixed at the top of the frame, and an output end the cylinder I is connected with the upper part of the rotary joint;

a compression and positioning system comprises: the guide sleeve II is fixed below the upper sliding plate; the compression column is matched with the guide sleeve II, and the pressure block is fixed below the compression column; the upper sliding plate is mounted below the upper fixed plate I via the guide rail III; the servo electric cylinder II is fixed on the left side below the upper fixed plate I, and the output end of the servo electric cylinder II is connected with the upper sliding plate; the servo electric cylinder III is fixed above the upper sliding plate, and an output end of the servo electric cylinder III is connected with the upper part of the compression column; the upper fixed plate I is fixed below the upper fixed plate II via the connecting block; the upper fixed plate II is mounted below the lifting plate via the annular guide rail; the servo motor II is fixed below the upper fixed plate II, and the gear III is fixed at the output end of the servo motor II; the gear III is engaged with the edge of the lifting plate; and this device comprises three compression and positioning systems;

a lifting system comprises: the four guide posts are fixed above the lifting plate; the four guide sleeves III are matched with the guide posts, and fixed at the top of the frame; the two cylinders II are also fixed at the top of the frame, and output ends of the two cylinders II are articulated with the top of the lifting plate.

2. The improved wheel end face detection and correction device according to claim 1, the outer ring of the lifting plate is a large gear, which is engaged with the three gears III.

* * * * *